US007725056B2

(12) United States Patent
Kosugi et al.

(10) Patent No.: US 7,725,056 B2
(45) Date of Patent: May 25, 2010

(54) TRIBOELECTRIC CHARGING DEVICE AND FIELD ASSISTED TONER TRANSPORTER

(75) Inventors: Hideki Kosugi, Sagamihara (JP); Ichiro Kadota, Kawasaki (JP); Kazumi Suzuki, Shizuoka (JP); Takeo Tsukamoto, Yokohama (JP)

(73) Assignee: Ricoh Co., Ltd., Tokyo (JP)

( * ) Notice: Subject to any disclaimer, the term of this patent is extended or adjusted under 35 U.S.C. 154(b) by 47 days.

(21) Appl. No.: 11/621,873

(22) Filed: Jan. 10, 2007

(65) Prior Publication Data

US 2007/0160395 A1 Jul. 12, 2007

(30) Foreign Application Priority Data

Jan. 10, 2006 (JP) ..... 2006-002028
Jan. 27, 2006 (JP) ..... 2006-018892
Oct. 20, 2006 (JP) ..... 2006-285710
Oct. 20, 2006 (JP) ..... 2006-285806

(51) Int. Cl.
*G03G 15/08* (2006.01)

(52) U.S. Cl. ..... 399/222; 399/229; 399/252; 399/119; 399/265

(58) Field of Classification Search ..... 399/222, 399/229, 252, 168, 111, 119, 265
See application file for complete search history.

(56) References Cited

U.S. PATENT DOCUMENTS 4,224,322 A * 9/1980 Roch et al. ..... 514/228.5
4,244,322 A * 1/1981 Nomura et al. ..... 399/275
5,027,152 A * 6/1991 Oda et al. ..... 399/111
5,124,749 A * 6/1992 Bares ..... 399/266
5,268,259 A * 12/1993 Sypula ..... 430/311
5,300,339 A * 4/1994 Hays et al. ..... 428/36.9
5,323,214 A * 6/1994 Kai ..... 399/289

(Continued)

FOREIGN PATENT DOCUMENTS

JP 59181372 A * 10/1984

(Continued)

OTHER PUBLICATIONS

U.S. Appl. No. 11/546,251, filed Oct. 12, 2006, Tsukamoto et al.

(Continued)

*Primary Examiner*—David M Gray
*Assistant Examiner*—G. M. Hyder
(74) *Attorney, Agent, or Firm*—Oblon, Spivak, McClelland, Maier & Neustadt, L.L.P.

(57) ABSTRACT

A developing device configured to form toner cloud without making toner particles adhere to the electrostatic transport substrate having electrodes. By applying periodical voltages to electrodes, electrically charged toner particles float on the electrostatic transport substrate. Also, a rotatable toner transporter designed to carry toner particles floating on the electrostatic transport substrate. Also, a two-component developer bearer including a sleeve with magnets on which the two-component developer is borne. The two-component developer borne on the sleeve is sent to the toner transporter by rotation of the sleeve. There, toner particles are transported to the toner transporter because of the electric bias applied between the two-component developer bearer and the toner transporter. Toner particles electrically floating on the toner transporter are sent to the photoconductor for development.

20 Claims, 8 Drawing Sheets

U.S. PATENT DOCUMENTS

| | | | | | |
|---|---|---|---|---|---|
| 5,396,026 | A * | 3/1995 | Sato et al. | 399/276 |
| 5,448,342 | A * | 9/1995 | Hays et al. | 399/285 |
| 5,517,287 | A * | 5/1996 | Rodriguez et al. | 399/285 |
| 5,701,553 | A * | 12/1997 | Endo et al. | 399/55 |
| 5,963,766 | A * | 10/1999 | Okuno et al. | 399/256 |
| 6,324,369 | B1 * | 11/2001 | Yamaguchi et al. | 399/254 |
| 6,603,943 | B2 * | 8/2003 | Yuuki et al. | 399/256 |
| 6,697,592 | B2 * | 2/2004 | Adachi et al. | 399/265 |
| 6,708,014 | B2 * | 3/2004 | Miyaguchi et al. | 399/266 |
| 6,901,231 | B1 * | 5/2005 | Sakai et al. | 399/266 |
| 7,099,611 | B2 * | 8/2006 | Aoki et al. | 399/281 |
| 7,236,727 | B2 * | 6/2007 | Fukuda | 399/269 |
| 7,308,222 | B2 * | 12/2007 | Nakagawa et al. | 399/265 |
| 2007/0048035 | A1 * | 3/2007 | Baba et al. | 399/323 |

FOREIGN PATENT DOCUMENTS

| | | |
|---|---|---|
| JP | 09-197781 | 7/1997 |
| JP | 09-329947 | 12/1997 |
| JP | 2002-341656 | 11/2002 |
| JP | 2003-228238 | 8/2003 |
| JP | 2004-101933 | 4/2004 |
| JP | 2004-157163 | 6/2004 |
| JP | 2004-170796 | 6/2004 |
| JP | 2004-205644 | 7/2004 |
| JP | 2004-219768 | 8/2004 |
| JP | 2004-341656 | 12/2004 |
| JP | 2005-062808 | 3/2005 |

OTHER PUBLICATIONS

U.S. Appl. No. 12/042,892, filed Mar. 5, 2008, Tsukamoto et al.
U.S. Appl. No. 12/209,812, filed Sep. 12, 2008, Aoki et al.
U.S. Appl. No. 12/176,054, filed Jul. 18, 2008, Kadota et al.
U.S. Appl. No. 12/261,302, filed Oct. 30, 2008, Kosugi et al.

* cited by examiner

TRIBOELECTRIC CHARGING DEVICE AND FIELD ASSISTED TONER TRANSPORTER

CROSS REFERENCE TO RELATED APPLICATIONS

This application claims priority to Japanese patent application No. 2006-018892 filed Jan. 27, 2006, Japanese patent application No. 2006-002028 filed Jan. 10, 2006, Japanese patent application No. 2006-285806 filed Oct. 20, 2006 and Japanese patent application No. 2006-285710 filed Oct. 20, 2006, the entire contents of each being incorporated herein by reference.

BACKGROUND OF THE INVENTION

1. Field of the Invention

A developing device for developing latent images into toner images has been used in an image forming apparatus.

2. Description of the Prior Art

Conventional developing devices include one-component developing devices or two-component developing devices. One-component developing devices develop latent images to toner images with developer containing toner particles but not containing carrier particles. Two-component developing devices develop latent images to toner images with developer containing toner particles and carrier particles.

Two-component developing devices are suitable for a high-speed image forming apparatus and are broadly used in medium-speed and high-speed image forming apparatuses. It is common to pack the two-component developer with high density when the developer touches latent images, in order to form a high quality image. To pack the two-component developer with high density, the diameter of carrier particles is reduced in size. Carrier particles with the diameter of 30 μm are commonly used. However, demand for high quality image has grown stronger, with the size of one pixel required to be equal to or smaller than the size of conventional carrier particles. Therefore, in terms of the reproducibility of isolated dots, it is desirable to reduce the size of carrier particles further.

However, when carrier particles are downsized, the magnetic permeability of carrier particles tends to decline, resulting in carrier particles dropping from a development roller during image production. If a carrier particle dropped from the development roller attaches to a latent image carrier, it will result in image distortion caused by adhesion. Dropped carrier particles also will result in additional side effects such as injury of the photoconductor. Various efforts has been tried to reduce the adhesion of dropped carrier particles. For example, research has been performed relative to material having higher magnetic permeability. Research has also been conducted to raise the magnetic power of magnets disposed within the development roller. However, it is difficult to find a solution that meets a requirement for low cost and a requirement for high quality of image at the same time. Moreover, with the trend of downsizing the developing device, the development roller is getting smaller and it is even more difficult to design a development roller having a strong enough magnetic field to suppress carrier particles.

In addition, two-component developing devices develop toner images with developer particles that are arranged along a magnetic field, thus forming a chain-like shape called a "magnetic brush" so that the developer particles are in contact with and rub latent images. This development process tends to result in the distorted toner image because of the unevenness of conventional magnetic brush density. Although it is possible to improve the image quality by applying an alternating bias between the development roller and the latent image carrier, it is difficult to remove the distortion of toner images caused by the unevenness of the magnetic brush in density.

In addition, it is desirable to reduce non-electrostatic adherence between toner particles and the latent image carrier when toner particles are transferred or removed from the latent image carrier. It is well known that the non-electrostatic adherence between toner particles and the latent image carrier can be reduced effectively by reducing a friction coefficient of the surface of the latent image carrier. However, reducing a friction coefficient tends to reduce the efficiency of development or reproducibility of isolated dots because the magnetic brush passes through the latent image carrier too smoothly.

On the other hand, one-component developing devices are frequently used in conventional low-speed image forming apparatuses because it has advantages of mechanical simplicity and easy downsizing. In conventional one-component developing devices, a regulating blade or roller is pressed to a development roller to form a thin layer of toner particles on a development roller, and toner particles are electrically charged due to the friction with the regulating blade, roller or the development roller. The electrically charged thin layer of toner particles is carried to a development area in which the development roller faces the latent image carrier.

The conventional one-component developing device is classified as a contact type or a non-contact type. In a contact type one-component developing device, the development roller is contact with the latent image carrier. In a non-contact type one-component developing device, the development roller is not contact with the latent image carrier. Toner particles are compressed on the development roller in either type of developing device, making it difficult for the toner particles to move smoothly in response to an applied electric bias. Therefore, a strong alternating bias is often applied between the development roller and the latent image carrier in order to obtain the high quality image. However, even when a strong alternating bias is applied, it is still difficult to stabilize the amount of toner particles to be adhered on to a certain area of latent image and to develop an isolated dot with high resolution uniformly. In addition, toner particles tend to deteriorate easily because of a strong stress that toner particles suffer when the thin layer of toner particles are formed. Once toner particles deteriorate, the thin layer of toner particles tends to be uneven. Therefore, one-component developing devices are not suitable for a high-speed image forming apparatus or for long time use.

To address one or more of the issues described above, Japanese Laid-Open Patent Publication No. 3-100575 discloses a hybrid type of developing device in which a one-component developing device and a two-component developing device compensate for demerits of each other. Although this type of developing device requires a larger space and more components, it solves some problems explained above. However, this device has the same problem as the conventional one-component developing device in that it is difficult to develop an isolated dot with high resolution uniformly.

Japanese Laid-Open Patent Publication No. 3-113474 discloses a developing device with high frequency alternating bias on a wire. The alternating bias is applied to the wire causing toner particles to form a toner cloud and makes it possible to improve the reproducibility of an isolated dot with high resolution. Although this type of the developing device requires a complicated structure, it makes it possible to develop latent images with high image quality stably.

Japanese Laid-Open Patent Publication No. 3-21967 discloses a developing device configured to form a toner cloud stably and effectively by forming an electric field curtain on a rotating roller. This type of developing device is suitable for obtaining toner images with high image quality and suitable for downsizing at the same time. However, this device requires specific set up conditions for forming an electric field curtains in order to obtain high image quality. If the development process is executed under wrong set up conditions, the image quality can be worse than that of other type of developing device.

Japanese Laid-Open Patent Publication No. 2002-341656 discloses another developing device configured to form a toner cloud. This developing device transports toner particles electrically with a driving alternating electric field of 3 or more phases instead of conveying toner particles mechanically by a toner carrier.

In order to stabilize the amount of electrical charge of toner particles, Japanese Laid-Open Patent Publication No. 2004-205644 proposes to provide a storage area in which toner particles are electrically charged by electrical voltage before being transported to an electrostatic transport substrate.

However, the developing devices shown in Japanese Laid-Open Patent Publication No. 2002-341656 and Japanese Laid-Open Patent Publication No. 2004-205644 each suffer certain deficiencies. Toner particles with weak charge tend to stay on the electrostatic transport substrate because toner particles with weak charge do not respond to electric field well. Therefore, a cleaner is required to remove toner particles on the electrostatic transport substrate.

In addition, the amount of toner particles transported on the electrostatic transport substrate tends to fluctuate in response to fluctuation of the charge amount of toner particles. The developing device shown in Japanese Laid-Open Patent Publication No. 2004-205644 is useful to enlarge the charge amount of toner particles but is not useful to make the charge amount of toner particles even. Therefore, for keeping high image quality, there is also a need to make the charge amount of toner particles even.

SUMMARY OF THE INVENTION

One object of the present invention is to provide a developing device to form toner cloud without making toner particles adhere to the electrostatic transport substrate.

A second object of the present invention is to stabilize the charge amount of toner particles in a developing device which forms toner cloud.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION

Figure 10:
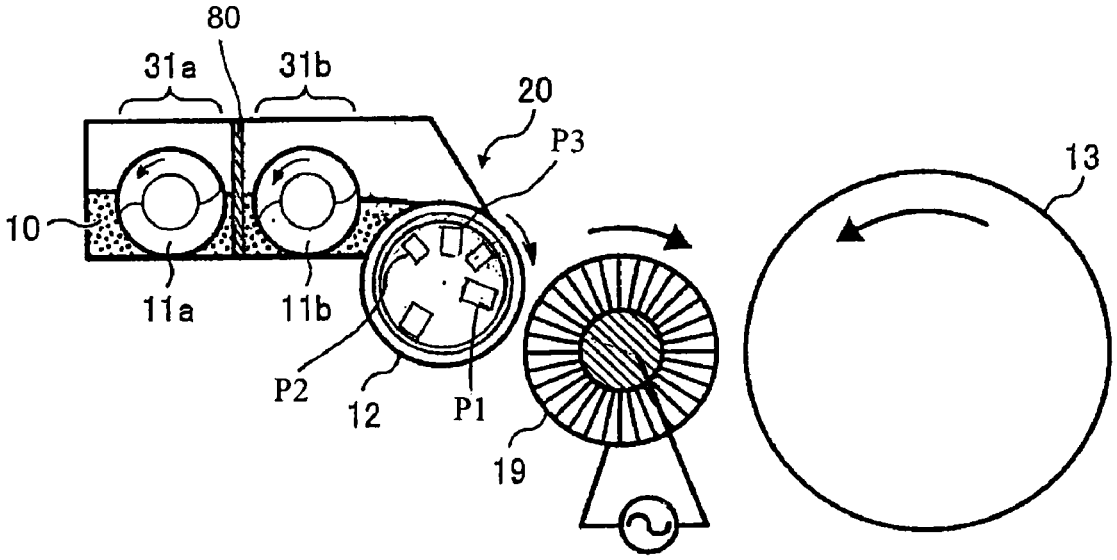
FIG. 10 shows an embodiment of a developing device to which the present invention can be applied according to one embodiment of the invention.

FIG. 10 shows an embodiment of a developing device to which the present invention can be applied. The developing device 20 includes a toner transporter 19, a two-component developer bearer 12 and two agitator 11*a* and 11*b*. The toner transporter 19 is disposed nearby a latent image carrier 13 (hereinafter, a photoconductor 13) to transport toner particles to the photoconductor 13 for development process.

The toner transporter 19 includes an electrostatic transport substrate on a surface. The toner transporter 19 is formed as a roller and is designed to rotate in order to carry toner particles to the photoconductor 13 for development.

The electrostatic transport substrate is designed to include electrodes.

The electric field is generated by applying alternating voltages to the electrodes. More specifically, two groups of electrodes are disposed in a manner that an electrode belonging to one group and another electrode belonging to another group are disposed one after another. Then alternating voltages are applied to both groups of electrodes in a manner that a phase of an alternating voltage applied to one group of electrodes shifts half of one period of the alternating voltage from the phase of the alternating voltage applied to another group. Hereinafter, the one group of electrodes may be expressed as "odd-numbered electrodes" and the other group of electrodes may be expressed as "even-numbered electrodes".

The odd-numbered electrodes are connected with each other. The even-numbered electrodes are connected with each other. A periodical voltage such as an alternating voltage or rectangular shaped voltage or the like is applied to the odd-numbered electrodes. Another periodical voltage whose shape is the same as the voltage applied to the odd-numbered electrodes and whose phase is shifted half of wavelength is applied to the even-numbered electrodes. By applying those two voltages, electrically charged toner particles float on the electrostatic transport substrate. Here, the word "float" means a situation in which there is a time that toner particles on the toner transporter do not contact the electrostatic transport substrate. Therefore, the word "float" does not mean a situation in which toner particles on the toner transporter always keep away from the on the toner transporter.

In addition, the toner transporter 19 is designed to move by rotation in order to carry toner particles floating on the electrostatic transport substrate. In a conventional developing device having an electrostatic transport substrate, the electrostatic transport substrate is not designed to move in order to carry toner particles. Instead, it is designed to carry toner particles using only electric field.

The two-component developer bearer 12 includes a non-magnetic sleeve on which the two-component developer is borne and magnets within the sleeve, just like a well-known developing roller used in a conventional two-component developing device. There are convexes and concaves on the two-component developer bearer 12.

Two-component developer 10 is contained in the developing device 20 and includes magnetic carrier particles of average particle diameter 55 μm and polyester toner particles of average particle diameter about 6 μm. The weight ratio (i.e., the weight of toner particles divided by weight of the two-component developer) is from 5 to 7% by weight.

The two-component developer 10 is agitated and conveyed by the agitator 11*a* and 11*b*, with the developer circulating within and between the agitator 11*a* and 11*b*. The agitator 11*b* agitates and conveys the two-component developer 10 to the downstream while supplying a part of the two-component developer 10 to the two-component developer bearer 12. The two-component developer 10 is sent to upstream of the agitator 11*a* from downstream of the agitator 11*b*. The agitator 11*a* agitates and conveys the two-component developer 10 to the downstream. The two-component developer 10 is sent upstream of the agitator 11*b* from the downstream end of the agitator 11*a*. Here, "downstream" or "upstream" of an agitator means the "downstream in the conveying direction of the developer" or "upstream in the conveying direction of the developer", respectively.

The two-component developer 10 is borne by the sleeve, and is attracted by a magnetic force caused by the magnets within the sleeve. The two-component developer 10 borne on the sleeve is sent to the toner transporter 19 by rotation of the sleeve. There, the two-component developer 10 is arranged to stand along the magnetic field caused by the magnets within the sleeve, forming a brush like shape. Then, the brush of the two-component developer 10 contacts the surface of the toner transporter 19. Then toner particles in the brush are transported to the toner transporter 19 because of the electric bias applied between the two-component developer bearer 12 and the toner transporter 19.

On the toner transporter 19, an electric field makes toner particles float.

Toner particles electrically floating on the toner transporter 19 are sent to the photoconductor 13.

Latent images will have been formed on the photoconductor by exposing electrically charge surface of the photoconductor. The difference between average electric voltage of the toner transporter 19 and electric voltage of the photoconductor makes a partial transport of toner particles to the image area of the latent images in order to develop latent images to toner images. Toner particles that are not used for development are sent back to the two-component developer bearer 12. Since the toner transporter 19 is moving, if toner particles having very weak electric charge adhere to the toner transporter 19, those toner particles are separated from the toner transporter 19 in response to the movement of the toner transporter 19. And since toner particles are floating, adhesion force that makes toner particles adhere to the toner transporter 19 is very weak and therefore toner particles are easily scraped off and collected by the brush of the two-component developer 10. Thus, with the present invention, toner adhesion to the electrostatic transport substrate is improved.

Toner particles are repeatedly supplied to the development area in which the toner transporter 19 faces to the photoconductor 13 by repeating above-mentioned motion.

The developing device 20 and the photoconductor 13 may be contained within a process cartridge. The process cartridge is designed to be detachable from a main body of the image forming apparatus. Therefore, when the developing device or the photoconductor wears out, maintenance is executed by simply replacing the process cartridge.

Figure 1:
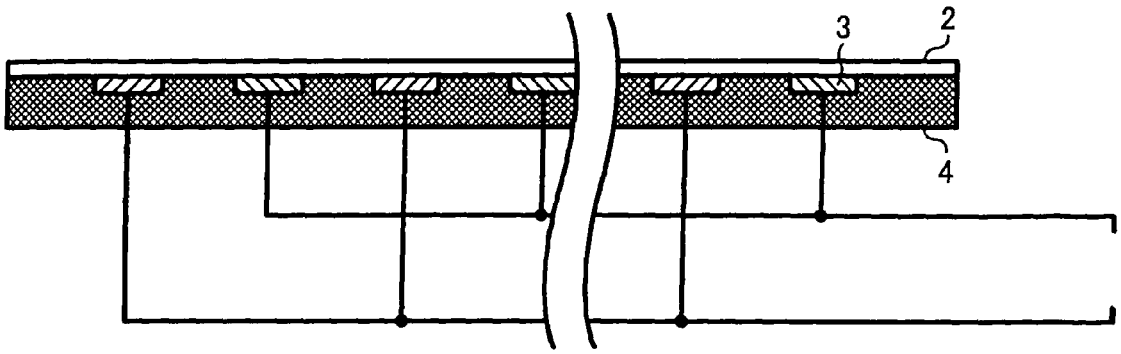
FIG. 1 shows the electrostatic transport substrate according to one embodiment of the invention.

FIG. 1 shows the electrostatic transport substrate. Electrodes pattern 3 are formed on a glass substrate 4 by aluminum evaporation. A resin layer 2 is formed on the electrodes pattern 3 as a coating layer. The thickness of the resin layer is 3 μm and the volume resistivity value of the resin is 10th power of 10 [Ωcm].

An embodiment regarding the application of a bias between the two-component developer bearer 12 and the toner transporter 19 is discussed next.

In the developing device described above, the amount of toner particles carried on the electrostatic transport substrate fluctuates in response to the fluctuation of the electrical charging amount of toner particles. The inventors of the present invention have found that it is possible to stabilize the distribution of an amount of electrical charge of toner particles by applying a direct bias to transport toner particles from the two-component developer bearer 12 to the toner transporter 19. Here, "bias" is a difference of voltage between two objects.

Figure 2:
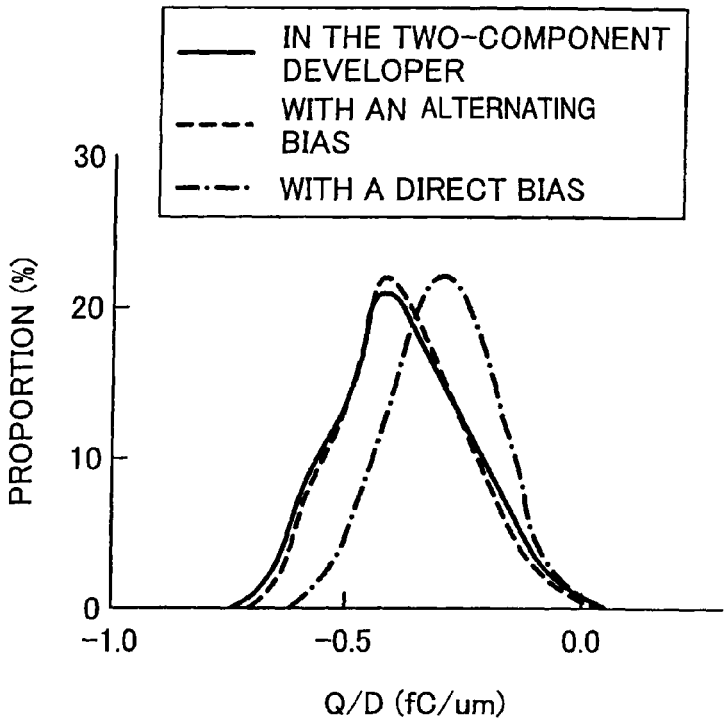
FIG. 2 shows three distributions of electrical charging amount of toner particles according to one embodiment of the invention.

FIG. 2 shows three distributions of electrical charging amount of toner particles. Two dots lines show the distributions of electrical charging amount of toner particles on the electrostatic transport substrate. Each line indicates the distribution when direct bias or alternating bias is applied between the two-component developer bearer 12 and the toner transporter 19. The solid line indicates the distribution of electrical charging amount of toner particles in the two-component developer. The charge per distance [Q/D] is expressed in units of Femtocoulomb per micrometer (fC/μm).

In this experiment, magnetic carrier particles of average particle diameter 55 μm and polyester toner particles of average particle diameter about 7 μm were used. The weight ratio (i.e., weight of toner particles divided by weight of the two-component developer) was from 5 to 7% by weight. Toner particles used in this experiment were contained in the developing device during continual printouts and the average charging amount of toner particles was about −30 μC/g.

It is shown in FIG. 2 that two distributions of electrical charging amount of toner particles on the electrostatic transport substrate, expressed by two dots lines, are different from each other. When the alternating bias is applied, a momentary strong bias makes even the toner particles with too high of an electric charging amount move to the toner transporter 19. The toner particles with too high of an electric charging amount adhere to the electrostatic transport substrate strongly and are not easily transported to the photoconductor 13. On the other hand, when the direct bias is applied, only the toner particles that are easily transported to the photoconductor 13 are selectively supplied to the toner transporter 19.

Figure 3:
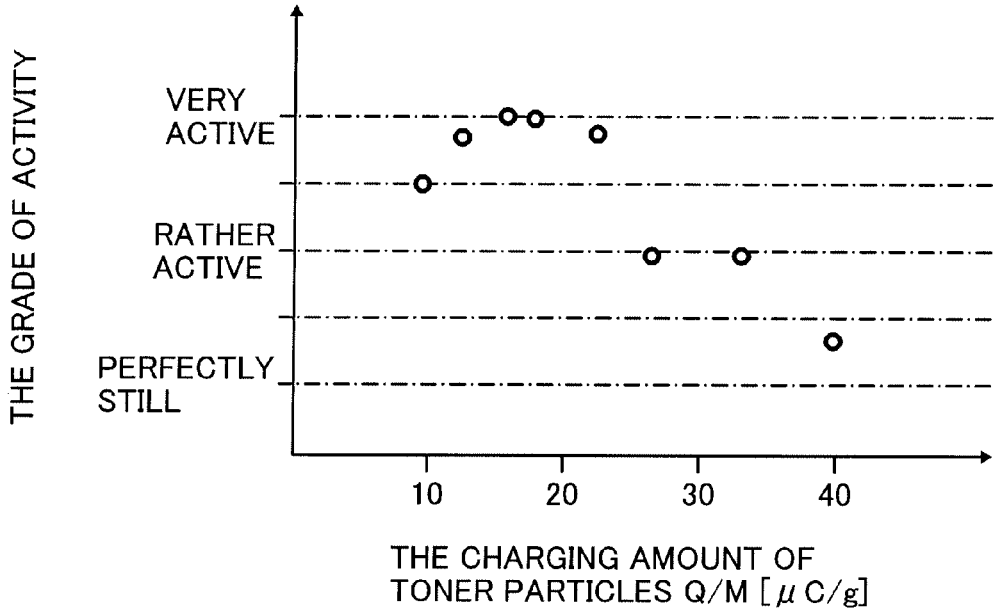
FIG. 3 shows the relationship between the charging amount of toner particles and the grade of activity according to one embodiment of the invention.

FIG. 3 shows the relationship between the charging amount of toner particles measures in μC/g and the grade of activity of toner particles on the electrostatic transport substrate. Here, "the grade of activity of toner particles" is a result of a sensory test method. If an observer observing the motion of toner particles estimates that all toner particles (100%) are bouncing on the electrostatic transport substrate, the result of test is estimated as "very active". If the observer estimates that no toner particles (0%) are bouncing, the result of test is estimated as "perfectly still". If the observer estimates half of all of toner particles (50%) are bouncing, the result of test is estimated as "rather active". The observer can choose an intermediate point. If the observer estimates that X % of toner particles are bouncing, the observer can plot a point that divides the distance between "perfectly still" and "very active" into two segments each having the proportion X % and 100-X %. The distance between "perfectly still" and the plot corresponds to X % and the distance between the plot and "very active" corresponds to 100-X %.

The toner particles with too high of an electric charging amount are not easily moved away from the electrostatic transport substrate because of a strong image force. A suitable charging amount is required to effectively activate the motion of toner particles. In the two-component developer, the charging amount of toner particles varies because of its continuous agitation and mixture with carrier particles or its continuous consumption and replenishment. The fluctuation of the charging amount makes the activity of toner particles on the electrostatic transport substrate fluctuate. Therefore, as shown in FIG. 2, it is preferable to stabilize the distribution of charging amount of toner particles by applying the direct bias between the two-component developer bearer 12 and the toner transporter 19.

Even if the direct bias is applied, the deterioration of developer over time tends to result in a deterioration of the charging amount of toner particles. However, it is possible to improve the deterioration of the charging amount of toner particles by arranging a development condition.

Figure 4:
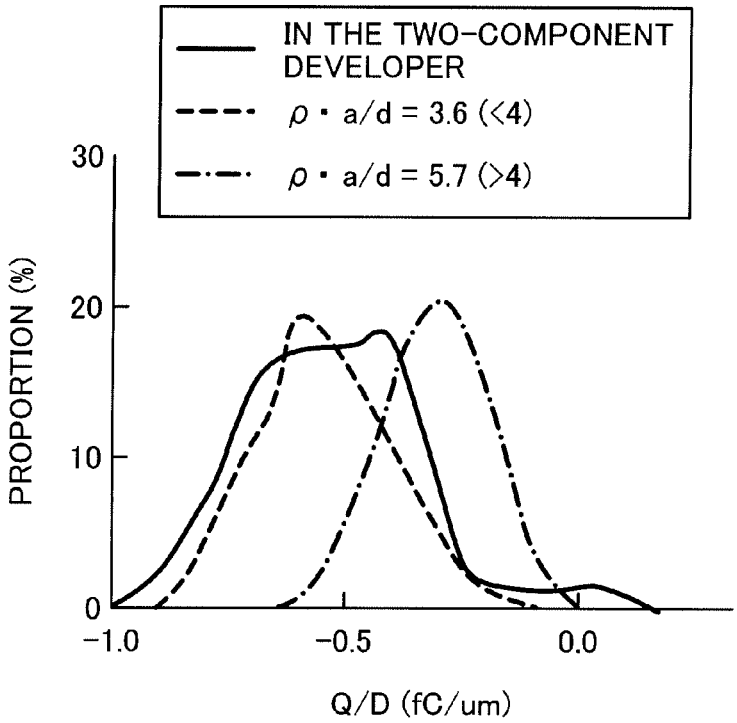
FIG. 4 shows distributions of electrical charging amount of toner particles in the developer after the developer deteriorates.

In FIG. 4, the solid line shows a distribution of charging amount of toner particles in the developer after the developer deteriorates. In this experiment, the condition of development is the same as that of the previous experiment summarized in FIG. 2.

The dotted line corresponds to condition "ρ·a/d=5.7 mg/mm$^3$" and shows the distribution of the charging amount of toner particles on the electrostatic transport substrate when the distribution of the charging amount of toner particles in the two-component developer deteriorates like with the solid line in FIG. 4. The detailed condition of development is as follows:

$$\rho \cdot a/d = 5.7 \text{ mg/mm}^3$$

d=0.35 mm

ρ=1 mg/mm$^2$ a=2

Here, "d" is the distance between the two-component developer bearer 12 and the toner transporter 19. "ρ" is the weight of the developer on the two-component developer bearer 12 in the area of 1 mm$^2$. "a" is a ratio of speed which is peripheral speed of the toner transporter 19 divided by peripheral speed of the two-component developer bearer 12.

FIG. 4 shows that the distribution of the charging amount of toner particles, expressed in fC/μm, on the electrostatic transport substrate is almost the same as the distribution of the charging amount of toner particles in the developer in FIG. 2. Therefore, the distribution of the charging amount of toner particles on the electrostatic transport substrate is well preserved even when the distribution of the charging amount of toner particles in the developer deteriorates. By way of experimentation, the present inventors found that the distribution is well preserved if the value ρ·a/d is greater than 4mg/mm$^3$.

The dotted line corresponding to condition "ρ·a/d=3.6 mg/mm$^3$" shows the distribution of the charging amount of toner particles on the electrostatic transport substrate when the distribution of the charging amount of toner particles in the two-component developer deteriorates like with the solid line in FIG. 4. The detailed condition of development is as follows:

$$\rho \cdot a/d = 3.6 \text{ mg/mm}^3$$

d=0.55 mm

ρ=1 mg/mm$^2$ a=2

FIG. 4 shows that, in this condition, the distribution of the charging amount of toner particles deteriorates in response to the deterioration of the distribution of the charging amount of toner particles in the two-component developer. The reason for this deterioration is explained as follows:

Supplying toner particles with a relatively weak charging amount to the electrostatic transport substrate becomes difficult because the adhesion of toner particles to carrier particles increases.

Because many toner particles exist in the area in which toner particles are transported from the two-component developer bearer 12 to the toner transporter 19, toner particles with unsuitable charging amount are supplied to the toner transporter 19.

In various experiments, the relationship between the volume resistivity value of the surface of the electrostatic transport substrate and the grade of activity was examined in order to investigate the effect of the electrical characteristics of the electrostatic transport substrate. Silicone resin was used as the material of the surface of the electrostatic transport substrate and the electrostatic transport substrate having the volume resistivity value from 7th power of 10 [Ωcm] to 14th power of 10 [Ωcm] was achieved by changing the amount of carbon fine particles in the silicone resin. The thickness of the coat layer was about 5 μm.

Figure 5:
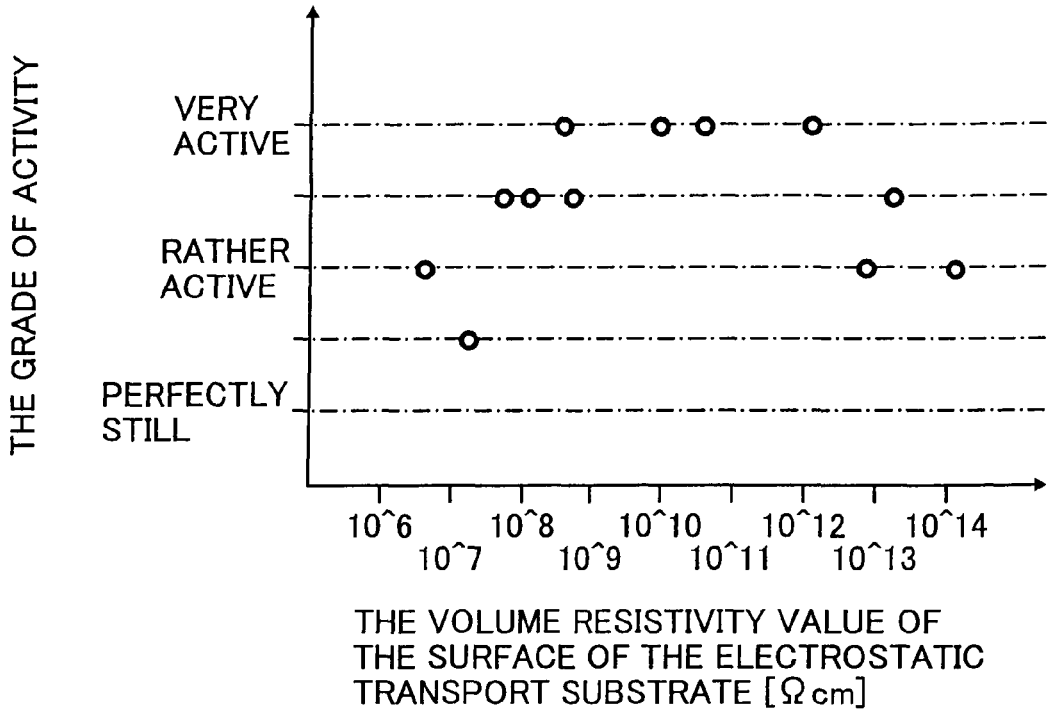
FIG. 5 shows the relationship between the volume resistivity value of the surface of the electrostatic transport substrate and the grade of activity according to one embodiment of the invention.

FIG. 5 shows the relationship between the volume resistivity value of the surface of the electrostatic transport substrate and the grade of activity. Through experimentation, it can be seen that it is preferable to arrange the volume resistivity value to be from 9th power of 10 [Ωcm] to 12th power of 10 [Ωcm]. If the volume resistivity value is greater than 12th power of 10 [Ωcm], the surface of the toner transporter 19 will remain electrically charged by continuous friction with toner particles. If the volume resistivity value is smaller than 9th power of 10 [Ωcm], the leak of electrical charge may occur between electrodes and the effectiveness of electric bias may be reduced. Therefore, it is preferable to arrange the volume resistivity value of the surface of the electrostatic transport substrate to be from 9th power of 10 [Ωcm] to 12th power of 10 [Ωcm] in order to remove the electrical charge caused by the friction with toner particles and in order to control the leak of electrical charge between electrodes.

In addition, the grade of activity was examined with two different coating layers: one made from silicone resin and another made from fluorine resin. Each of two layers was arranged to have the volume resistivity value to be from 11th power of 10 [Ωcm] to 12th power of 10 [Ωcm] by dispersing carbon fine particles in the layer.

The grade of activity was examined with alternating voltage applied to each electrostatic transport substrate. It was observed that toner particles were kept floating on the substrate made from silicone resin. On the other hand, toner particles adhered to the substrate made from fluorine resin after a short time of floating.

The charging amount of toner particles on each of electrostatic transport substrate was measured after the examination of grade of activity. It was observed that the charging amount of toner particles on the substrate made from silicone resin had only declined slightly from an initial value. On the other hand, the charging amount of toner particles on the substrate made from fluorine resin had almost vanished. It turned out that when uncharged toner particles were rubbed against the substrate made from silicone resin, toner particles were electrically charged with a polarity that toner particles were supposed to have in the development process (regular polarity). On the other hand, when uncharged toner particles were rubbed against the substrate made from fluorine resin, toner particles were hardly charged or even charged with a polarity opposite of the regular polarity.

Therefore, since toner particles repeatedly collide with the electrostatic transport substrate, it is preferable to use the material as the substrate that gives a regular polarity to toner particles during its contact with toner particles.

Suitable material the electrostatic transport substrate can be selected properly by considering the frictional series of material. Glass materials or materials used as a coating layer of carrier particles are suitable for the surface material of the electrostatic transport substrate.

Figure 6:
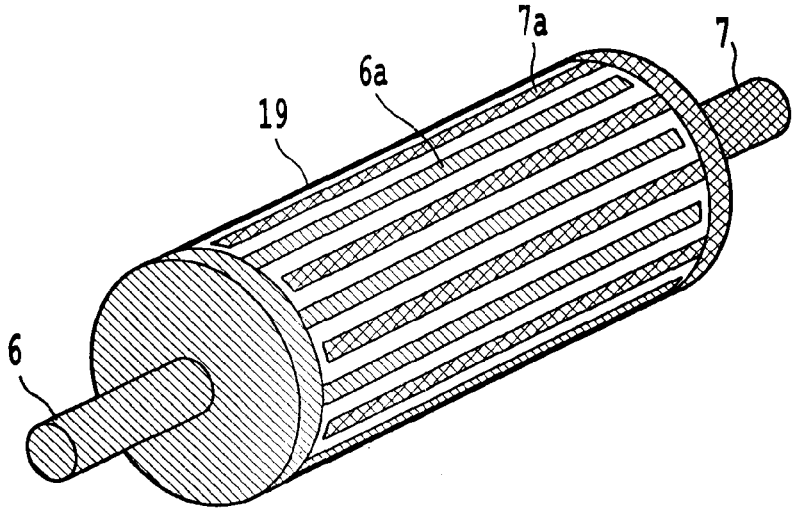
FIG. 6 shows a broad overview of the toner transporter according to one embodiment of the invention.

The detailed structure of typical toner transporter 19 (toner transporter roller) is shown in FIG. 6.

FIG. 6 shows toner transporter 19. The toner transporter 19 can rotate while being held by an axis 6 and an axis 7. The conductive axis 6 sticking out from one end of the toner transporter 19 connects to odd-numbered electrodes. And the conductive axis 7 sticking out from another end of the toner transporter 19 connects to even-numbered electrodes. Electric voltage is applied to each of the axes 6, 7 through an electrically conductive material such as a conductive brush (not shown). The axes 6, 7 are electrically isolated from each other.

Figure 7A:
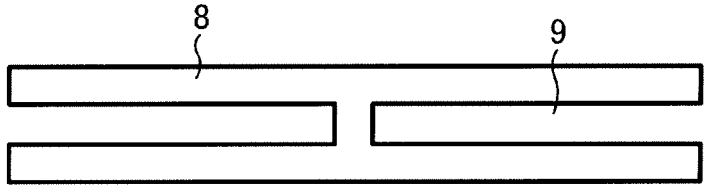
FIGS. 7A, 7B, 7C, 8A, 8B, 8C, 8D, 8E and 9 show a process to produce the toner transporter according to one embodiment of the invention.

The toner transporter 19 is produced as follows:

Making holes 9 along the central axis of a cylindrical acrylic resin 8 as shown in FIG. 7A.

Figure 7B:
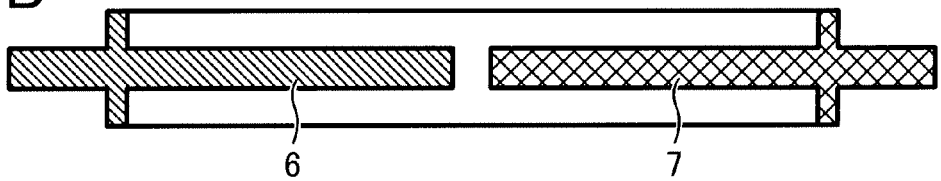
Figure 7C:
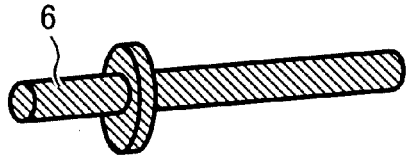
Figure 8A:
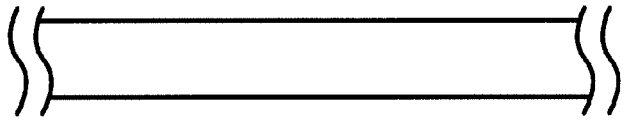
Figure 8B:
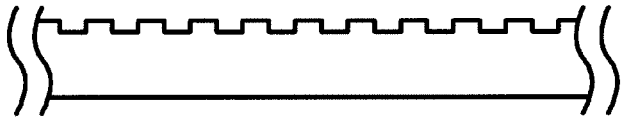
Figure 8C:
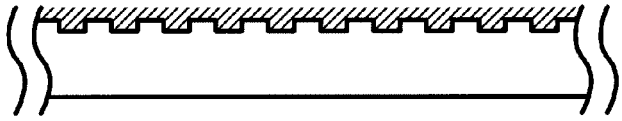
Figure 8D:
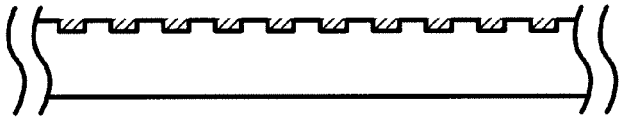
Figure 8E:
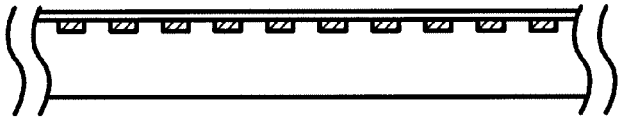

Inserting electrode axes 6 and 7 in the holes 9 as shown in FIGS. 7B and 7C.

Making electrodes pattern by following the process shown in FIG. 8A to FIG. 8E.

FIGS. 8A, 8B, 8C, 8D and 8E show cross sections of the toner transporter 19 cut by a plain that is perpendicular to the central axis. As a first step shown in FIG. 8A, the surface of the roller obtained by the process shown in FIG. 7A, 7B and 7C are cut to be smooth. As a second step shown in FIG. 8B, the surface of the roller is then cut to make trenches each having 50 μm width. The distance between trenches is arranged to be 100 μm. As a third step shown in FIG. 8C, electroless nickel plating is executed on the surface of the roller. As a fourth step shown in FIG. 8D, outer surface of the roller is cut in order to remove unnecessary conductive coating layer. Thus, electrodes are formed in the trenches. As a fifth step shown in FIG. 8E, the surface of the roller is coated by silicone resin in order to smooth the surface and to form the coating layer having the thickness of 5 μm and the volume resistivity value of 10th power of 10 [Ωcm].

Figure 9:
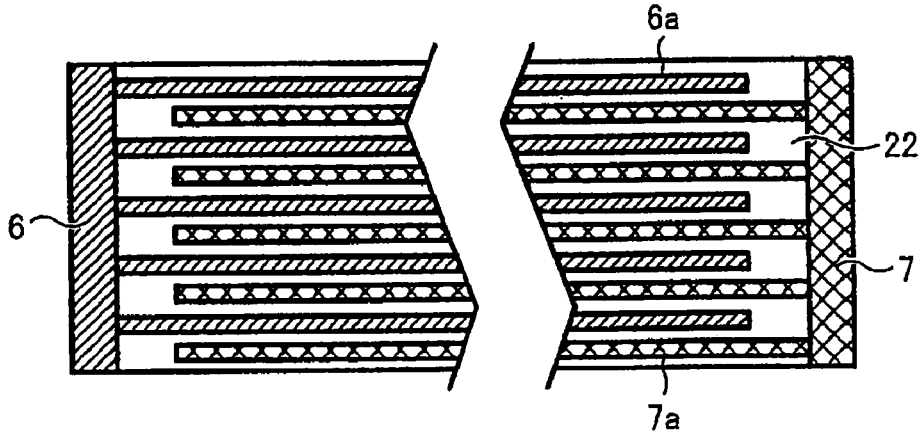

In FIG. 9, electrodes 6*a*, 7*a* and nonconductor 22 are arranged one after another in the rotating direction of the toner transporter 19. Alternating voltages are applied to both electrodes 6*a* and 7*a* by way of the conductive axis 6 and 7 in a manner that a phase of an alternating voltage applied to electrodes 6*a* shifts half of one period of the alternating voltage from the phase of the alternating voltage applied to electrodes 7*a*. Therefore, the electric bias is formed between the electrodes 6*a* and 7*a*.

The alternating voltages applied to electrodes 6*a* and 7*a* are the same waveform except for the phase. The alternating voltages have peak voltage value of −400V and 0V (average value is −200V) and having a frequency of 5 kHz. It is preferable for the amplitude of the alternating voltage to be from 200 V to 1000 V and a frequency of the alternating voltage to be from 0.5 kHz to 5 kHz.

Because an electric voltage of −400 V is applied to the two-component developer bearer 12 and because the average voltage of the toner transporter 19 is −200 V, the toner particles moves from the two-component developer bearer 12 to the toner transporter 19 by the electric bias.

Thus, the developing device that makes toner particles float on the toner transporter 19 and carries toner particles to development area by rotating the toner transporter 19 is invented.

An embodiment of an agitator is discussed next. In above-mentioned type of developing device, it is important that toner particles supplied to the toner transporter 19 are electrically charged with adequate polarity, because the floating condition of toner particles depends on the electric charge of toner particles. Therefore, it is advantageous to charge toner particles quickly. The inventors have found that it is advantageous to reinforce the friction between toner particles and carrier particles by increasing the density of the developer in agitation space in the developing device.

Figure 11A:
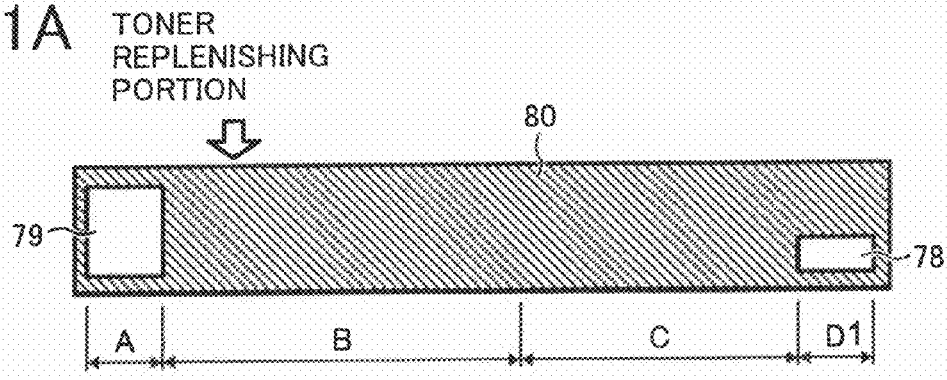
FIG. 11A shows a partition according to one embodiment of the invention.

FIG. 11A shows a partition 80 which partitions the agitator 11*a* and 11*b*. The agitator 11*a* and 11*b* is contained in the agitation space 31*a* and 31*b*, respectively as shown in FIG. 10. The partition 80 partitions the agitator space 31*a* from the agitator space 31*b* except two openings 78 and 79.

In this embodiment, either of the agitator 11*a* and 11*b* has a shape of screw and rotates in order to convey and agitate the developer 10. The developer 10 agitated by the agitator 11*b* is conveyed to downstream of the conveying direction of the agitator 11*b* and moves through the opening 79. Then the developer is agitated and conveyed by the agitator 11*a* to downstream of the conveying direction of the agitator 11*a* and moves through the opening 78 to the agitator 11*b*.

Figure 11B:
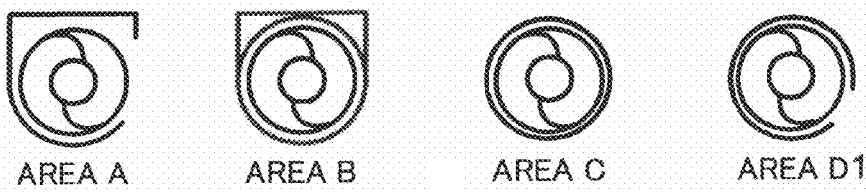
FIG. 11B shows cross sections of the agitation space 31*a* according to one embodiment of the invention.

FIG. 11 B shows cross sections of the agitation space 31*a*. Each of the four drawings accompanied by words "A", "B", "C" and "D1" in FIG. 11B corresponds to the cross section at area "A", "B", "C" and "D1" shown in FIG. 11A, respectively. In the cross section corresponding to the area A or B, the internal wall of the agitation space 31*a* has a broader space than that of the area C or D1. The shape of internal wall is the same as that in the area B except there is the opening 79 in the area A. Toner particles are replenished to the area B in this embodiment. Therefore, it is preferable that replenished toner particles are mixed with the developer well within the area B.

In the cross section corresponding to the area C or D1, the internal wall of the agitation space 31*a* forms a round shape along the outer peripheral of the screw. The shape of internal wall in the area D1 is the same as that in the area C except there is the opening 78 in the area D1. Therefore the developer is packed with high density in this area C and D1.

In this embodiment, the developing device is designed so that the agitation space 31*a* can be filled with the developer only in area of C and D1. Here, the term "filled with developer" means the situation in which the developer is contact with all circumferences of the internal wall substantially continuously.

In addition, since the upper part of the internal wall is along the outer peripheral of the screw, rotation of the screw can agitate every part of the developer although the agitation space 31*a* is filled with the developer. Therefore, the agitator 11*a* can mix and convey the developer effectively.

In addition, in the area in which the agitation space 31*a* is filled with the developer, the developer rubs against each other effectively. This rubbing causes dispersion and electrification of toner particles. Therefore, toner particles are adequately charged at the upstream of the agitator 11*b* and a high quality image can be formed during the development process without toner scattering and toner adhesion to non-image area.

In this embodiment, the distance between the internal wall and the outer peripheral of the screw is designed to be 1 mm. Other distances for other embodiments are possible.

In a conventional two-component developing device, a regulating blade is not only used to regulate the amount of the developer but is also used to charge toner particles by friction. On the other hand, when toner particles are effectively charged in the agitator space 31*a*, a regulating blade does not have to charge toner particles as much as the conventional developing device. Therefore, it is possible to weaken the stress on the developer imposed by the regulating blade and to prolong the lifetime of the developer.

It is preferable to arrange the widthwise length of the area in which the agitation space 31*a* is filled with the developer to satisfy the following relation.

$$0.1L<x<0.4L \quad (1)$$

Figure 12:
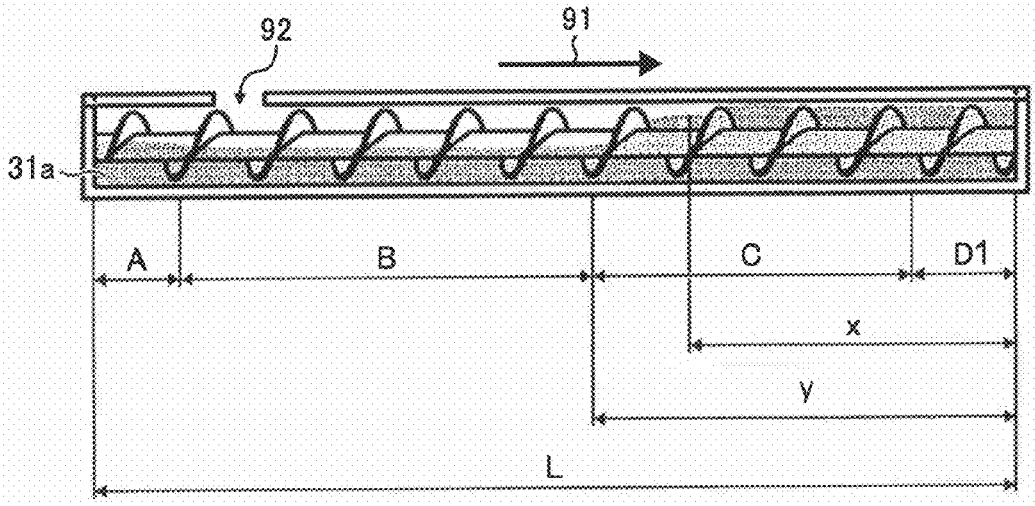
FIG. 12 shows a drawing of the agitation space and the relation between length L, x and d according to one embodiment of the invention.

Here, "L" is the width length of the agitation space 31*a*, "x" is the widthwise length of the area in which the agitation space 31*a* is filled with the developer. FIG. 12 shows the drawing of the agitation space 31*a* and agitator 11*a* seen from the agitator 11*b*. The length L, x and y described relative to FIG. 12. The length y is the widthwise length of area C and D together. New toner particles are replenished from a toner replenishing opening 92 and the arrow 91 indicates the conveying direction of the developer. In this embodiment, the length of the sleeve of two-component developer bearer 12 is arranged to be equal to the length of the agitation space 31*a*.

If the length x is greater than 40% of the length L, the length of other area becomes not greater than 60% of the length L. Since the other area is suitable for dispersion of toner particles because of the lower height of the developer, the dispersion of toner particles may fall off. If the length x is not greater than 10% of the length L, toner particles may not be agitated and charged sufficiently before being sent to the development area. Therefore, it is possible to make toner particles be sufficiently dispersed and charged by satisfying the relation (1).

It is preferable to satisfy the following relation (2):

$$X<y \quad (2)$$

It is more preferable to make the length d not greater than 50% of the length L. It is more preferable that d is not greater than 40% of the length L.

By satisfying relation (2), the internal wall has a round cross section along the outer peripheral of the screw everywhere in the area filled with the developer. Therefore, the developer does not stay still and moves smoothly. In addition, such a configuration effectively charges toner particles because the developer can be rubbed effectively against the internal wall, the screw 11*a* and the developer itself. Thus, toner particles can be charged effectively before reaching the sleeve and toner images can be formed without toner scattering or toner adhesion to the non-image area of latent images.

In this embodiment, the length y is designed to be 40% of the length L.

It is preferable that area of the opening 78 is less than 30% of area of the opening 79. Such a restriction makes it difficult for the developer to move from the agitation space 31*a* to the agitation space 31*b*. Therefore, the developer is packed with high density at the downstream of conveying direction of the agitator 11*a* and the developer can be rubbed more effectively against the internal wall, the screw 11*a* and the developer itself. Thus, toner particles can be charged more effectively before reaching the sleeve and toner images can be formed without toner scattering or toner adhesion to the non-image area of latent images.

In this embodiment, the area of the openings 79 is about 800 [mm2] and the area of the openings 78 is about 180 [mm2]. Other dimensions for other configurations are possible.

Although both openings are preferably designed to have rectangle shape, the openings can have other shapes. For example, each opening can have one or plural polygon shape or one or plural round shape. Although the opening is positioned at near bottom of the partition, the position of each opening can vary as long as a part of opening is lower than the height of the developer. Also, a shutter for controlling the area of the opening can be used.

The agitator 11*a* that can be applied to the present invention will be described.

In this embodiment, a spiral blade screw having 25 mm of the winding pitch, 320 mm of widthwise length is used.

It is preferable to design the shape of the agitator 11*a* so that the force used to convey the developer in widthwise direction at the upstream position is greater than that of downstream position and the shear force in circumferential direction at the upstream position is smaller than that of downstream position. Such a shape of the agitator 11*a* makes the height of the developer at the downstream greater than that at the upstream. It also makes the height of the developer at the downstream so high that the developer reaches the upper part of the internal wall and the agitation space 31*a* at downstream is filled with the developer.

Some examples of the agitator 11*a* are described next.

Figure 14:
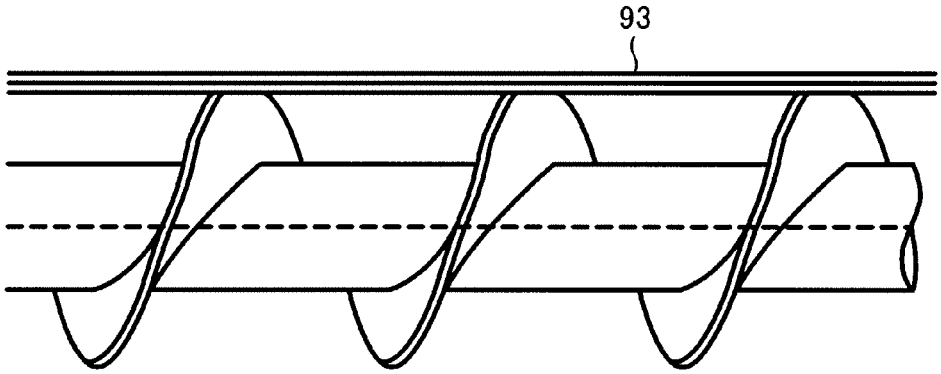
FIG. 14 shows a board disposed at the outer peripheral of a screw according to one embodiment of the invention.

It is preferable to add a board 93 as shown in FIG. 14 at the outer peripheral of a screw at the downstream of the conveying direction so that the force to convey the developer in widthwise direction at the upstream is greater than that of downstream and the shear force in circumferential direction at the upstream is smaller than that of downstream.

Figure 15A:
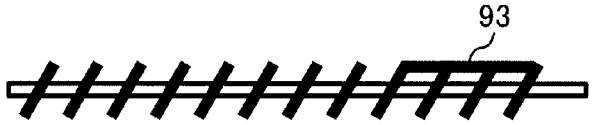
FIGS. 15A, 15B and 15C show some examples of the agitator according to one embodiment of the invention.

FIG. 15A is a simplified drawing of a screw with the board 93. The board 93 connects with outer peripheral of the screw at the most downstream position and covers three winding pitch. Since the board reinforces the shear force in circumferential direction, the developer is compressed strongly at the downstream.

Figure 15B:
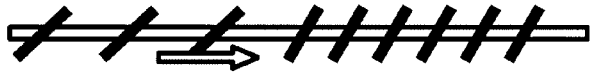

For another example, it is preferable to make the winding pitch of the screw so that the pitch at the downstream of the screw is smaller than that at the upstream. In FIG. 15B, the winding pitch of the screw is designed to be 50 mm at the upstream half of the screw and the winding pitch of the screw is designed to be 25 mm at the upstream half of the screw. In other words, since the length of the screw is 320 mm, the upstream part of the screw having 160 mm length has the winding pitch 50 mm and the downstream part of the screw having 160 mm length has the winding pitch 25 mm.

Therefore, at the downstream of the conveying direction, the developer is conveyed slower than upstream and the developer is compressed at the downstream end. When the developer is compressed, the developer is effectively rubbed each other and toner particles are effectively charged.

Figure 15C:
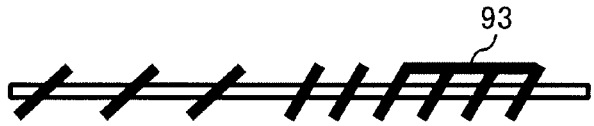

Another example is shown in FIG. 15C. The upstream part of the screw having 160 mm length has the winding pitch 50 mm and the downstream part of the screw having 160 mm length has the winding pitch 25 mm. In addition, the board 93 connects with outer peripheral of the screw at the most downstream position and covers three winding pitch.

The conveying speed of the developer at the downstream is slower than that at upstream because of the difference of the winding pitch and the existence of the board 93. In addition, since the board 93 makes the shear force in circumferential direction stronger, the developer is compressed effectively at the downstream.

Designing the height of the developer to be above-mentioned condition makes following three merits.

First, since the height of the developer is low nearby the toner replenishing opening 92, newly replenished toner particles is easily mixed and dispersed in the developer. If toner particles are replenished to the position in which the height of the developer is high, replenished toner particles tend to be conveyed while remaining on the developer as the layer of new toner particles. These toner particles are called "superficial toner particles". The "superficial toner particles" hardly contact with carrier particles, remain uncharged and can be the cause of toner scattering.

Second, since the height of the developer is getting higher along the conveying direction of the developer, the "superficial toner particles" is dammed on the way to downstream. Therefore, even if the "superficial toner particles" can not be prevented perfectly, it is possible to prevent the "superficial toner particles" from being conveyed to the downstream.

Third, since the height of the developer is high at the downstream, the developer is packed with high density at the downstream of conveying direction of the agitator 11*a* and the developer can be rubbed more effectively against each other. Thus, toner particles can be charged effectively before reaching the sleeve and toner images can be formed without toner scattering or toner adhesion to the non-image area of latent images.

In this embodiment, the screw having a winding pitch 12.5 mm and 2 threads is used as the agitator 11*a* and 11*b*. The sleeve of the two-component developer bearer 12 is made of aluminum and has been polished by sandpaper.

Figure 13A:
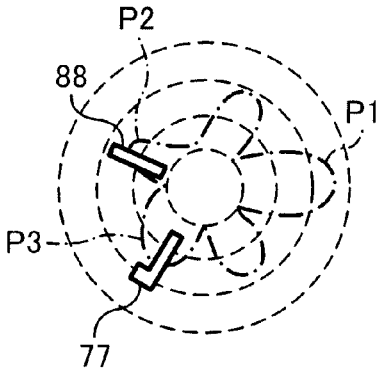
FIGS. 13A and 13B show a magnetic flux density in the normal direction according to one embodiment of the invention.

The two-component developer bearer 12 in this embodiment has a magnetic flux density in the normal direction as shown in FIG. 13A. P1 is a magnetic field to form a magnetic brush, P2 is a magnetic field to release the developer from the sleeve and P3 is a magnetic field to attract the developer. A regulating blade 77 regulates the amount of the developer on the sleeve. A releasing blade 88 removes the developer from the sleeve. After supplying toner particles to the toner transporter 19, the developer on the sleeve is pushed out from the sleeve along the releasing blade 88 according to rotation of the sleeve, sent back to the agitator 11*b* and agitated with the developer having high toner density.

Figure 13B:
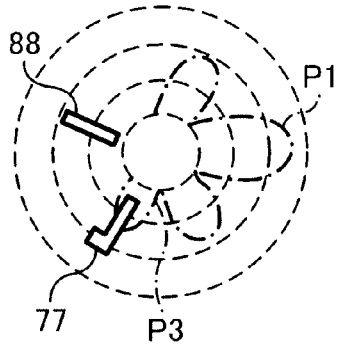

Another preferable magnetic flux density in normal direction is shown in FIG. 13B. In comparison with FIG. 13A, P2 is designed to be zero and P3 is designed to be smaller at the upstream of the regulating blade 77 than that at downstream.

Since the releasing blade 88 removes the developer physically, the developer does not stay on the sleeve even if the P2 does not exist. Therefore, toner particles can be supplied to the toner transporter 19. Also, since the amount of the developer attracted by the magnetic flux density nearby the regulating blade 77 is small, the stress imposed on the developer is reduced. Thus, by using magnets having the magnetic flux density shown in FIG. 13B, the lifetime of the developer can be prolonged and the charging amount of toner particles can be stabilized for long.

In a conventional developing device, if the stress on the developer imposed by the regulating blade is reduced, some problems occur. For example, fine particles from toner particles tend to adhere to the carrier particles. For example, toner particles tend to have insufficient charging amount because toner particles are not rubbed against the developer nearby the regulating blade. These problems result in toner scattering or toner adhesion to the non-image area of latent images.

However, since toner particles are electrically charged in the agitation space, the regulating blade 77 only needs to regulate the developer and does not need to impose strong stress on the developer in order to charge toner particles. Therefore, the stress imposed on the developer can be reduced and lifetime of the developer can be prolonged.

The process of development will be described. In this embodiment, an organic photoconductor having 13 μm thickness of a photosensitive layer is used as the photoconductor 13. And a laser scanning system with the resolution of 1200 dpi is used.

The surface of the photoconductor 13 is charged to be −300V. Then the laser scanning system radiates light to form latent images on the photoconductor 13 in the condition that exposed area is discharged to be −50V. The average charging amount of toner particle is designed to be −22 μC/g and the average particle diameter is designed to be 6 μm.

Under these conditions, the other parameters are adjusted in order to search a condition under which toner adhesion to the non-image area of latent images are sufficiently suppressed, the lack of toner is sufficiently suppressed in solid toner images and isolated dot is reproduced. As a result, it turned out that all requirements are satisfied in a following condition.

The gap between the toner transporter 19 and the photoconductor is about 500 μm The voltage applied to the conductive axis 6 and 7 is an alternating voltage having peak voltage value of −400V and 0V (average value is −200V) and having the frequency of 5 kHz. The phase of the alternating voltage applied to the conductive axis 6 shifts half of the period of the alternating voltage from the phase of the alternating voltage applied to the conductive axis 7.

It is preferable to design the average value of the voltage applied to the odd-numbered electrodes to be a value (−200V in this embodiment) between voltage value of the image area in latent images (−50V in this embodiment) and voltage value of the non-image area in latent images (−400V in this embodiment) and to design the average value of the voltage applied to the even-numbered electrodes to be a value (−200V in this embodiment) between voltage value of the image area in latent images (−50V in this embodiment) and voltage value of the non-image area in latent images (−400V in this embodiment).

If excessive toner particles exist on the toner transporter 19, the electric field formed by alternating voltage is distorted and toner particles do not float properly. Therefore, it is preferable to apply a direct voltage between the sleeve of the two-component developer bearer 12 and the toner transporter 19 in order to arrange the amount of toner particles on the toner transporter to be 0.2 mg/mm2. The absolute value of the direct voltage is about 200V.

On the other hand, it is preferable to supply toner particles with the density of 0.4 mg/mm2 in order to develop solid toner images. Therefore, it is preferable to make the surface speed of the toner transporter 19 to be equal to or greater than twice the surface speed of the photoconductor 13 in order to supply enough toner particles. In this embodiment, the surface speed of the toner transporter 19 is designed to be 2.5 times of the surface speed of the photoconductor 13.

The rotating direction of the toner transporter 19 and the rotating direction of the two-component developer bearer 12 can be same direction or counter direction. On the other hand, it is preferable that the toner transporter 19 and the two-component developer bearer 12 rotate in the same direction as shown in FIG. 10 in order to reinforce the force to scavenge toner particles from the toner transporter 19 after development.

In this embodiment, the surface speed of the photoconductor 13 is adjusted to be 300 mm/sec.

Under these conditions, toner adhesion to the non-image area of latent images is sufficiently suppressed, the lack of toner is sufficiently suppressed in solid toner images, and an isolated dot is effectively reproduced.

Figure 16:
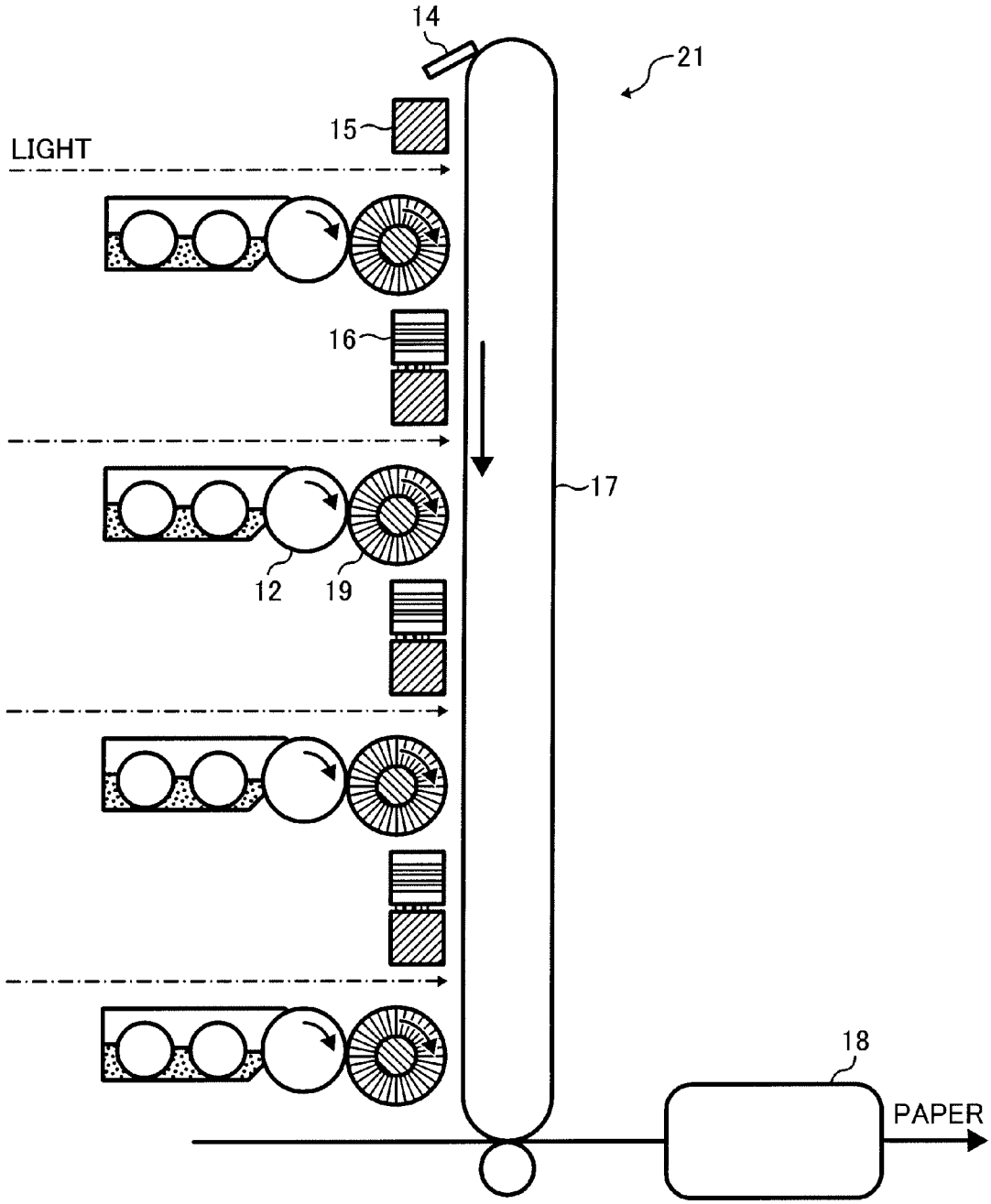
FIG. 16 shows an example of a color image forming apparatus according to one embodiment of the invention.

FIG. 16 shows an example of a color image forming apparatus 21 to which the present invention can be applied. Four developing devices each having the structure explained in FIG. 10 are arranged along the photoconductor belt 17 (a latent image carrier). Each color of toner image is formed on the photoconductor belt 17 by charging the photoconductor belt 17 using the charger 15, writing latent images with the light, developing the latent images to toner images with the developing device. Four toner images each having different color are superimposed on the photoconductor belt 17 to form a full-color image. The full-color image is transferred to a paper and fixed by the fixing device 18. The residual toner particles on the photoconductor belt 17 are removed by a cleaning blade 14.

Since four latent images are formed on the same photoconductor belt 17, the positional gap between each color is improved compared with the system in which four photoconductors are used.

In addition, since the developing device as shown in FIG. 10 barely scrapes a toner image on the photoconductor, a toner image formed by a developing device at upstream is barely distorted by a developing device at downstream and toner particles barely move in a developing device from the photoconductor belt 17. Therefore a high quality image can be formed.

It is possible to use a conventional developing device as a developing device disposed at the most upstream of the moving direction of the photoconductor belt and use the developing device 20 as a developing device disposed at downstream. Here, the position at which first color toner images are formed is the most upstream.

What is claimed is:

1. A developing device configured to develop latent images to toner images, comprising:

a toner transporter including an electrostatic transport substrate on a surface, configured to receive toner particles onto the electrostatic transport substrate and configured to move in order to carry toner particles floating on the electrostatic transport substrate to a latent image carrier; and a two-component developer bearer configured to carry a two-component developer to the toner transporter, wherein a surface of the electrostatic transport substrate is coated by a coating layer the coating layer including a material configured to charge toner particles in contact with the electrostatic transport substrate to regular polarity, and the two-component developer bearer and the toner transporter are arranged and controlled in accordance with the following relation:

$\rho \cdot a/d > 4$ mg/mm$^3$, wherein d is a distance measured in mm between the two-component developer bearer and the toner transporter, ρ is a weight measured in mg of the two-component developer on the two-component developer bearer in an area of 1 mm$^2$, and a is a ratio of speeds where a peripheral speed of the toner transporter is divided by a peripheral speed of the two-component developer bearer.

2. The developing device according to claim 1, wherein the electrostatic transport substrate includes first and second groups of electrodes, an electrode belonging to the first group and another electrode belonging to the second group are disposed one after another in a toner transporter rotation direction, and the first and second group of electrodes are electrically isolated from each other.

3. The developing device according to claim 1, wherein an average value of a voltage applied to a plurality of odd-numbered electrodes is between a voltage value of a latent image area and a voltage value of a non-latent image area, and an average value of a voltage applied to a plurality of even-numbered electrodes is between the voltage value of the latent image area and the voltage value of the non-latent image area.

4. The developing device according to claim 3, wherein the toner transporter is formed as a rotatable roller held by a first axle and a second axle, and the first group of electrodes are connected to the first axle and the second group of electrodes are connected to the second axle.

5. A process cartridge configured to be detachable, comprising:

the developing device according to claim 1; and a latent image carrier configured to carry latent images.

6. An image forming apparatus, comprising:

a latent image carrier configured to carry latent images;

a first developing device adjacent to a first position of the latent image carrier and configured to develop a first color toner image; and the developing device according to claim 1 adjacent to the latent image carrier at a position downstream of the first position and configured to develop a second color toner image superimposed on the first color toner image.

7. The developing device according to claim 1, wherein a surface of the electrostatic transport substrate is coated by a coating layer having a volume resistivity value from a $9^{th}$ power of 10 [Ωcm] to a $12^{th}$ power of 10 [Ωcm].

8. A developing device configured to develop latent images to toner images, comprising:

a toner transporter including an electrostatic transport substrate on a surface, configured to receive toner particles onto the electrostatic transport substrate and configured to move in order to carry toner particles floating on the electrostatic transport substrate to a latent image carrier; and a two-component developer bearer configured to carry a two-component developer to the toner transporter, wherein toner particles are transported from the two-component developer bearer to the toner transporter, and the two-component developer bearer and the toner transporter are arranged and controlled in accordance with the following relation:

$\rho \cdot a/d > 4$ mg/mm$^3$, wherein d is a distance measured in mm between the two-component developer bearer and the toner transporter, ρ is a weight measured in mg of the two-component developer on the two-component developer bearer in an area of 1 mm$^2$, and a is a ratio of speeds where a peripheral speed of the toner transporter is divided by a peripheral speed of the two-component developer bearer.

9. The developing device according to claim 8, further comprising:

a bias voltage device configured to apply a direct bias to at least one of the toner transporter and the two-component developer bearer so that toner particles are transported from the two-component developer bearer to the toner transporter.

10. The developing device according to claim 8, further comprising:

a first agitator space containing a first agitator configured to agitate and convey the two-component developer in a first direction to a second agitator space containing a second agitator and to the two-component developer bearer, and to receive the two-component developer from said second agitator; and said second agitator space containing said second agitator configured to agitate and convey the two-component developer in a second direction substantially opposite from the first direction, to receive the two-component developer from the first agitator and to supply the two-component developer to the first agitator, wherein the second agitation space has a first area having an internal wall forming a round shape along an outer periphery of the second agitator, the first area positioned at a downstream end of a second agitator developer conveying direction, and a second area at an upstream end of the second agitator developer conveying direction, wherein the two-component developer is in contact with all circumferences of an internal wall of the second agitation space substantially continuously only within the first area.

11. The developing device according to claim 10, wherein the first area of the second agitator space is divided into a downstream length and an upstream length, the downstream length corresponding to a section of the second agitator space where the two-component developer is in contact with all circumferences of an internal wall substantially continuously and configured to satisfy the following relation:

$0.1L < x < 0.4L$, wherein x is a length of the first area, and

L is a total length of the second agitation space.

12. The developing device according to claim 10, further comprising:

a first opening through which the two-component developer moves from the second agitation space to the first agitation space;

a second opening through which the two-component developer moves from the first agitation space to the second agitation space, wherein an area of the first opening is less than 30% of an area of the second opening.

13. The developing device according to claim 10, wherein the second agitator comprises means for conveying the two-component developer downstream with a force that is greater at the upstream end than at the downstream end, and for applying a shear force in a circumferential direction at the upstream end smaller than a shear force in the circumferential direction in the downstream end.

14. The developing device according to claim 10, wherein the second agitator includes:

a screw, and a board in contact with an outer periphery of a downstream end of the screw.

15. The developing device according to claim 10, wherein the second agitator includes a screw having an upstream winding pitch that is longer than a downstream winding pitch.

16. The developing device according to claim 10, further comprising:

a regulating blade configured to regulate an amount of two-component developer on the two-component developer bearer; and a releasing blade configured to remove the two-component developer from the two-component developer bearer after image development, wherein the two-component developer bearer includes a rotatable sleeve with magnets within the rotatable sleeve, and a magnetic flux density in a normal direction near the releasing blade is substantially zero.

17. A developing device configured to develop latent images to toner images, comprising:

a moving unit configured to move a toner transporter and carry toner particles floating on an electronic substrate of the toner transporter to a latent image carrier; and a charging unit configured to apply a direct bias to one of the toner transporter and a two-component developer bearer so that toner particles are transported from the two-component developer bearer to the toner transporter, wherein the two-component developer bearer and the toner transporter are arranged and controlled in accordance with the following relation:

$\rho \cdot a/d > 4$ mg/mm$^3$, wherein d is a distance measured in mm between the two-component developer bearer and the toner transporter, ρ is a weight measured in mg of the two-component developer on the two-component developer bearer in an area of 1 mm$^2$, and a is a ratio of speeds where a peripheral speed of the toner transporter is divided by a peripheral speed of the two-component developer bearer.

18. The developing device according to claim 17, further comprising:

means for contacting the toner transporter in order to supply toner particles to the toner transporter for a development process; and means for scraping toner particles after the development process off from the toner transporter.

19. A developing method, comprising:

supplying toner particles to a toner transporter coated with a coating layer including a material configured to charge toner particles in contact with the coating layer to regular polarity;

charging the toner particles to regular polarity by contacting the coating layer;

floating the toner particles on a moving electronic substrate of the toner transporter and carrying the floating toner particles to a latent image carrier; and scraping residual toner particles from the moving electronic substrate, wherein the two-component developer bearer and the toner transporter are arranged and controlled in accordance with the following relation:

$\rho \cdot a/d > 4\ \mathrm{mg/mm^3}$, wherein d is a distance measured in mm between the two-component developer bearer and the toner transporter, ρ is a weight measured in mg of the two-component developer on the two-component developer bearer in an area of 1 $mm^2$, and a is a ratio of speeds where a peripheral speed of the toner transporter is divided by a peripheral speed of the two-component developer bearer.

20. The developing method of claim 19, comprising:

applying a direct bias to one of the toner transporter and a two-component developer bearer so that toner particles are transported from the two-component developer bearer to the toner transporter.

* * * * *